US006083600A

United States Patent [19]

Kasai et al.

[11] Patent Number: 6,083,600

[45] Date of Patent: Jul. 4, 2000

[54] STABILIZED PERFLUOROPOLYETHER LUBRICANT

[75] Inventors: Paul Kasai, Morgan Hill; Charles Gordon Wade, Los Gatos, both of Calif.

[73] Assignee: International Business Machines Corporation, Armonk, N.Y.

[21] Appl. No.: 09/041,058

[22] Filed: Mar. 10, 1998

[51] Int. Cl.[7] ..... G11B 5/725

[52] U.S. Cl. ..... 428/65.4; 428/694 TF; 428/421; 428/900

[58] Field of Search ..... 428/421, 694 TF, 428/900, 65.4; 360/135

[56] References Cited

U.S. PATENT DOCUMENTS

| | | | |
|---|---|---|---|
| 4,085,137 | 4/1978 | Mitsch et al. | 260/561 HL |
| 4,268,556 | 5/1981 | Pedrotty | 428/65 |
| 5,037,710 | 8/1991 | Frew et al. | 428/695 |
| 5,049,410 | 9/1991 | Johary et al. | 427/131 |
| 5,252,400 | 10/1993 | Mizuno et al. | 428/421 |
| 5,776,602 | 7/1998 | Ueda et al. | 428/332 |

*Primary Examiner*—Stevan A. Resan
*Attorney, Agent, or Firm*—John J. Gresens; Thomas R. Berthold

[57] ABSTRACT

A lubricated thin film magnetic disk including a substrate; an underlayer deposited on the substrate; a magnetic alloy film deposited on the underlayer; an overcoat; and a film of lubricant deposited on the magnetic alloy film, the lubricant comprising an amine-stabilized perfluoropolyether polymer having a backbone comprising repeating units of:

$$-\!\!\left[(CF_2)_n-O\right]\!\!-$$

wherein n is an integer from 1 to 4 and the polymer backbone is terminated with at least one amine end group.

14 Claims, 3 Drawing Sheets

STABILIZED PERFLUOROPOLYETHER LUBRICANT

FIELD OF THE INVENTION

The invention relates generally to fluorine-based lubricants used to coat the surface of thin film magnetic disks used in hard disk drives. More specifically, the invention relates to the stabilization of perfluoropolyether lubricants against break down in the hard disk drive environment.

BACKGROUND OF THE INVENTION

Conventional magnetic disk drives are information storage devices which utilize at least one rotatable thin film magnetic media disk with concentric data tracks, a read/write transducer for reading and writing data on the various tracks, an air bearing slider for holding the transducer adjacent to the track generally and a flying mode above the media, a suspension for resiliently holding the slider and the transducer over the data tracks, and a positioning actuator connected to the suspension for moving the transducer across the medium to desired data track and maintaining the transducer over the data track during a read or a write operation.

The recording density of a thin film magnetic disk drive is limited by the distance between the transducer and the magnetic media. One goal of thin film hard disk drive design has been to provide a slider which will "fly" as closely as possible to the magnetic medium while avoiding physical impact with the medium. Small spacings, or "fly heights," are desired so that the transducer can distinguish between the magnetic fields emanating from closely spaced regions on the disk.

In addition to achieving a small average spacing between the thin film disk and the transducer, it is also critical that the slider fly at a relatively constant height. The large variety of conditions the transducers experience during the normal operation of a disk drive can make constancy of fly height anything but a given. As the flying height is not constant, the data transfer between the transducer and the recording medium may be adversely affected.

To ensure regular fly height, both thin film disks and sliders are often coated or finished with compositions which will lubricate the respective surfaces or provide a hard and smooth surface. Thin film magnetic disks are usually covered with a lubricant. Lubricants which may be used to coat thin film magnetic recording disks include Z-DOL, AM-2001, and Z-DIAC all available from Montedison of Italy, the Demnum series of lubricants available from, Daikin of Japan, including Demnum-SA, -SH, and -SP, and Krytox brand lubricant from DuPont.

Lubricants are generally chosen to prevent "sticktion" events or fluid friction events between the slider air bearing surface and the surface of the thin film magnetic disk. Lubricants may also be used to preclude or protect the surface of the thin film magnetic disk from direct contact with contaminants. Generally, lubricants are chosen for a particular application empirically based upon the best performance in the given application. For example, Pedrotty, U.S. Pat. No. 4,268,556 discloses fluorinated telechelic polyether polymers which may be used as a lubricant for particulate magnetic recording disks. The Pedrotty particulate disks have a surface which comprises particles of iron dispersed in a epoxy binder. The surface of the particulate disk is very rough which prohibits the head from flying close to the disk.

The disk drive environment can frustrate if not completely undermine the activity of the lubricant. For example, the presence of aluminum within the alloys used to fabricate thin film magnetic disks can lead to lubricant degradation and destabilization. Lubricant breakdown is thought to occur by acid/base reactions as well as electron transfer events. In turn, the breakdown of the lubricant undermines the protective function this film is intended to serve as a coating of a thin film magnetic disk.

One solution proposed has been the use of hexa-phenoxy-cyclo-triphosphazene which is commercially available as XIP from Minnesota Mining and Manufacturing Co. However, this lubricant is expensive and somewhat inefficient as there is a need to blend one or more solutions before application of the lubricant to the thin film magnetic disk.

Accordingly, there is a need for processes and compositions which may be used to stabilize lubricant films which are applied to thin film magnetic disks.

SUMMARY OF THE INVENTION

In accordance with a first aspect of the invention, there is provided a lubricated thin film magnetic disk comprising: a substrate; an underlayer deposited on the substrate; a magnetic alloy film deposited on the underlayer; an overcoat; and a film of lubricant deposited on the magnetic alloy film, the lubricant comprising an amine-stabilized perfluoropolyether polymer having a backbone comprising repeating units of:

$$-\!\!\left[(CF_2)_n-O\right]\!\!-$$

wherein n is an integer from 1 to 4 and the polymer backbone is terminated with at least one amine end group.

In accordance with a further aspect of the invention, there is provided a disk drive assembly comprising: a thin film magnetic disk, the disk comprising a disk substrate, an underlayer deposited on the substrate, a magnetic alloy film deposited on the underlayer, an overcoat, and a film of lubricant deposited on the magnetic alloy film, the lubricant comprising an amine-stabilized perfluoropolyether polymer having a backbone comprising repeating units of:

$$-\!\!\left[(CF_2)_n-O\right]\!\!-$$

wherein n is an integer from 1 to 4 and the polymer backbone is terminated with at least one amine group; means for rotating the thin film magnetic disk; a slider for reading magnetic data; and means for positioning the slider over the thin film magnetic disk to read magnetic data from the disk.

It has been shown that perfluoropolyethers have a propensity to undergo intermolecular reactions in the disk environment. These reactions lead to the breakdown of the lubricant and, in turn, raise the potential for stiction between disk and slider. The reaction is generally catalyzed by Lewis acid sites such as aluminum oxide formed on the substrate surface.

The process results in molecular chain scission arid formation of molecular fragments within acid end groups. Lubrication performance may be compromised. The disk proportionation reaction can be stemmed by stabilizing the perfluoropolyethers with amine end groups. Amine groups of secondary or tertiary form have extraordinary low ionization potentials. Attachment of such groups to perfluoropolyethers thus produces molecules of good miscibility, low volatility, and the ability to react with Lewis acid sites and thus permanently disable the catalytic property of the Lewis acid sites. Perfluoropolyethers with the amine groups may be used as ultrastable lubricants or may be used as additives to other perfluoropolyethers which have not been stabilized through the use of the amine end groups.

DETAILED DESCRIPTION OF THE PREFERRED EMBODIMENTS

The invention generally includes a lubricated thin film magnetic disk comprising: a substrate; an underlayer deposited on the substrate; a magnetic alloy film deposited on the underlayer; an overcoat; and a film of lubricant deposited on the magnetic alloy film, the lubricant comprising an amine-stabilized perfluoropolyether polymer having a backbone comprising repeating unites of:

$$-\!\!\left[(CF_2)_n-O\right]\!\!-$$

wherein n is an integer from 1 to 4 and the polymer backbone is terminated with at least one amine end group.

A. The Thin Film Magnetic Disk and Disk Drive

Figure 1:
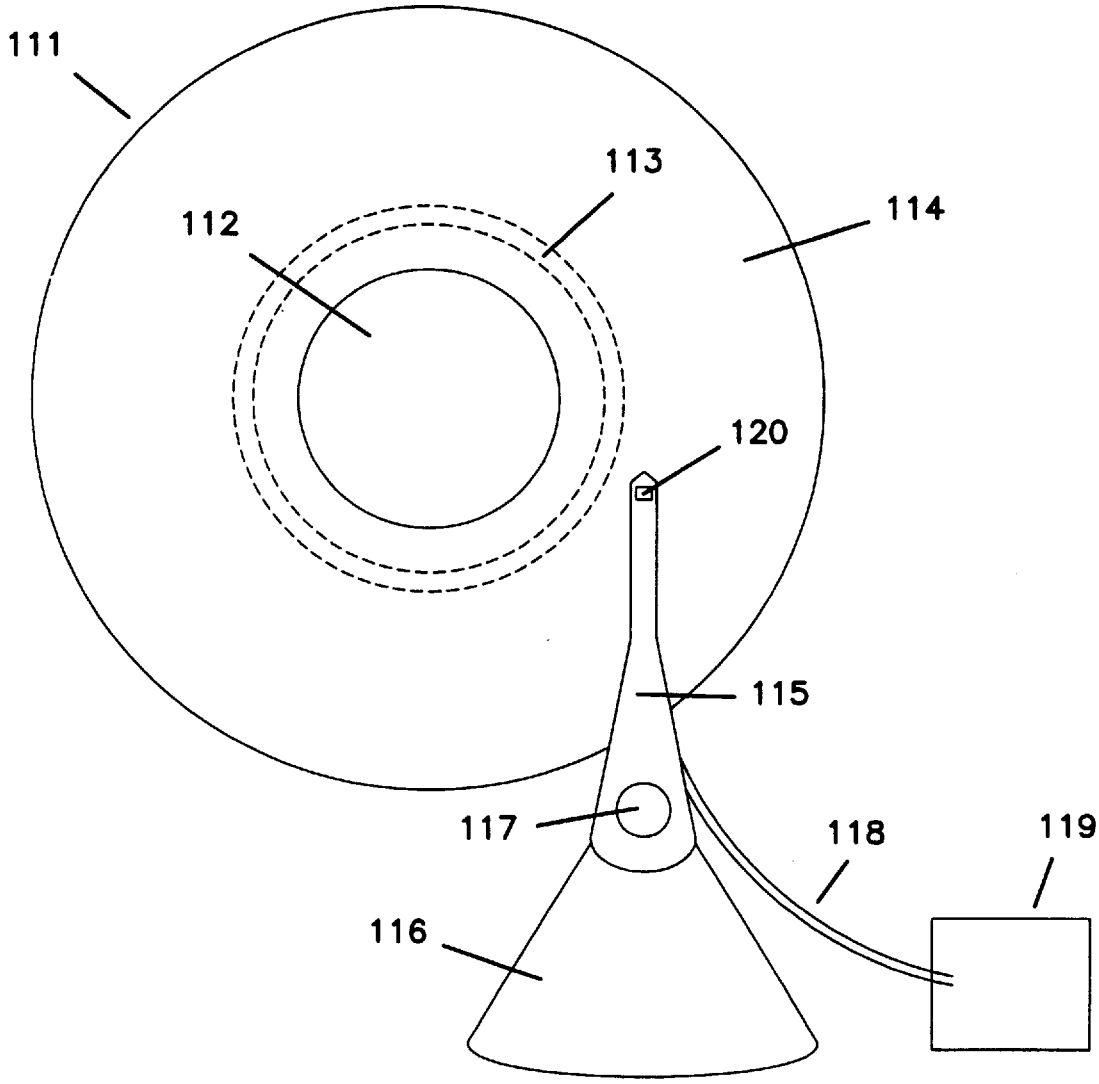
FIG. 1 illustrates a top view of a conventional disk drive with rotary actuator useful in practicing the claimed invention.

The invention may be used on any variety of thin film magnetic disks used in typical disk drive elements. For example, FIG. 1 is a top view illustrating a typical disk drive with a rotary actuator. The system comprises one or more magnetic recording disks 111 mounted on spindle 112 which is rotated by an in-hub electrical motor (not shown). An actuator assembly 115 supports a slider 120 which contains one or more read/write heads. The assembly may be composed of a plurality of actuators and sliders arranged in a vertical stack with the actuators supporting the sliders in contact with the surfaces of the disks when the disks are not rotating or being unloaded to avoid contact.

A voice coil motor (VCM) 116 moves the actuator assembly 115 relative to the disks by causing the assembly to pivot around shaft 117. The heads are typically contained in air bearing sliders adapted for flying above the surface of the disks when rotating at sufficient speed.

In operation, when the sliders are flying above the disks the VCM moves the sliders in an arcuate path across the disks allowing the heads to be positioned to read and write from circular tracks formed in the data area 114 which is coated with the thin films which will be described in more detail below. Electrical signals to and from the heads and the VCM are carried by a flex cable 118 to the drive electronics 119. When not operating and during periods when the rotation of the disks is either starting or stopping, the sliders may be positioned in physical contact with the surface of the disks in a landing zone or contact start/stop (CSS) area 113 which is not used for data storage even though the magnetic coating extends over this area. It is also known to remove the sliders from the disks during nonoperating periods using an unload ramp. Although the disk drive has been described with air bearing sliders the disk of the present invention may easily be used in other storage devices having near contact, or contact recording sliders.

Figure 2:
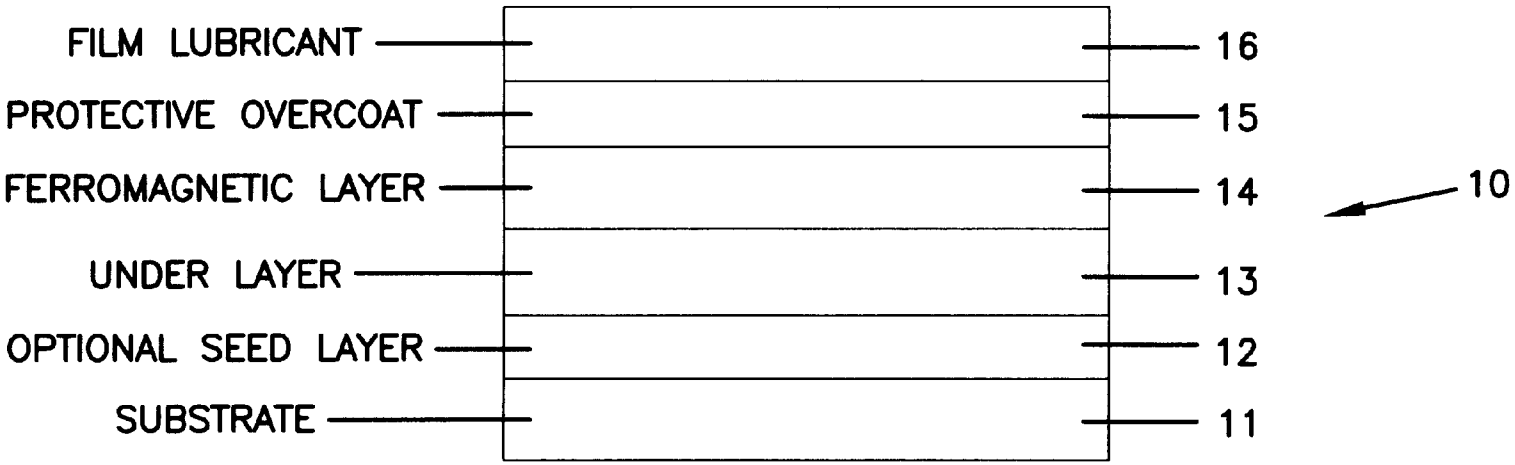
FIG. 2 illustrates the layer structure of a thin film magnetic disk according to the invention.

FIG. 2 illustrates the cross sectional layer structure of thin film magnetic disk 10 according to the invention which will be coated onto at least one and preferably both planar surfaces of the disk to form the data recording area The substrate 11 may be composed of a metallic material such as alloys of tin, aluminum or magnesium.

A seed layer 12 may be deposited onto the substrate to facilitate the adhesion of the underlayer and the formation of recording tracks. Seed layers are especially useful on thin film magnetic disks comprising non-metallic substrates.

The underlayer 13 may then be deposited onto the seed layer or the substrate, as applicable. Common materials for underlayers include metals and alloyed metals such as alloys of chromium and tin.

The ferromagnetic layer 14 is deposited onto the underlayer. Preferably, the ferromagnetic layer 14 is generally a metal alloy such as cobalt, platinum, chromium and boron (CoPtCrB). Generally, the disk also comprises a top layer 15 which is a protective overcoat which can be carbon, hydrogenated carbon, nitrogenated carbon or any other protective material. Generally, the carbon overcoat is very smooth having a root mean square roughness of about 2 to about 20 Å, preferably less than about 10 Å, more preferably about 2 to about 6 Å. Layers 12, 13, 14, and 15 may be deposited or formed using standard techniques, targets, temperatures and pressures. A film lubricant 16 is found on the thin film magnetic disk 10. Generally, the thickness of the film lubricant is less than about 10 angstroms.

The relative thickness of the layers is not believed to be critical for practicing the invention, but the following ranges are given as guidance. The seed layer, if present, is preferably from about 5 to 30 nm thick, more preferably from about 10 to 30 nm thick. The underlayer is typically much thicker than the seed layer, but wide variations in the thickness of the underlayer result in only small changes in the magnetic characteristics of the disk. A typical value for the thickness of the underlayer is 50 nm. The ferromagnetic layer is typically from 10–30 nm thick. The use, composition and thickness of the overcoat is not important in practicing the invention, but a typical thin film disk might use an overcoat less than 15 nm thick.

B. The Stabilized Lubricant

Generally, thin film magnetic disks prepared according to the invention comprise a lubricant film coated on carbon overcoat to enhance flyability of the surface of the disk. Conventional lubricants include those shown in Formulas (I) through (IV), below, which are identified by molecular structure, brand name and vendor. The number average molecular weight Mn for all these lubricants is suitably from 2000 to 8000.

Formula (I) is Z-DOL available from Montedison of Italy:

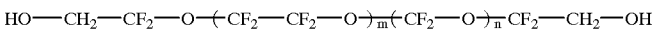

(I)

wherein the ratio of m/n is 2/3.

Formula (II) is AM2001 available from Montedison of Italy which has same backbone as Z-DOL with a different end group.

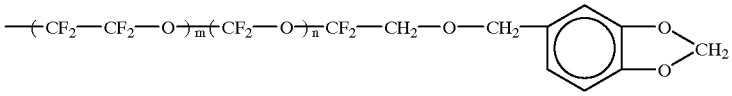

(II)

Formula (III) is Z-DIAC available from Montedison of Italy which has same backbone as Z-DOL with a different end group.

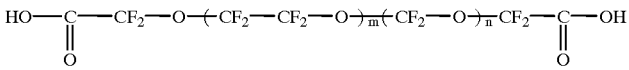

(III)

Formula (IV) through VI are Demnum-SA, -SH, and -SP, respectively available from Daikin of Japan:

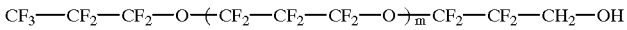

(IV)

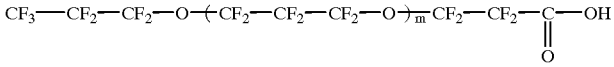

(V)

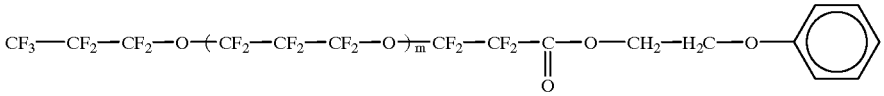

(VI)

wherein in each of Formulas (IV) through (VI) m is 10–50.

However, these polymers may break down in the disk drive environment. To stabilize the lubricant, these compounds and polymers may be capped with an amine end group. Preferably the amine end group has an ionization potential of less than about 9 ev, and preferably less than about 8 ev such as secondary or tertiary amine end group.

Representative amine compounds suitable to form amine end group include alkyl amines such as methylamine, dimethylamine, ethyl amine, diethylamine, n-propylamine, di-n-propylamine, isopropylamine, disopropylamine, allylamine, diallylamine, n-butylamine, di-n-butylamine, isobutylamine, diisobutylamine, sec-butylamine, t-butylamine, ethyl-n-butylamine, dimethyl-n-butylamine, n-amylamine, and di-n-amylamine; cycloaliphatic amines such as 1-methylcyclohexylamine, 2-methylcyclohexylamine, 3-methylcyclohexylamine, 4-methylcyclohexylamine, 3,3,5-trimethylcylohexylamine, 4-tert-butylcylohexylamine, N-methycycohexylamine N-ethylcyclohexylamine, N,N-dimethylcyclohexylamine, N,N-diethylcyclohexylamine, dicyclohexylamine, N-methyldicyclohexylamine, and 1-adamantylamine; and dicycloaliphatic amines such as 1,2-cyclohexanediamine, 1,3-cyclohexanediamine, methylcyclohexanediamine, 1,3-cyclohexanediamine,2-methyl, 1,3-cyclohexanediamine,4-methyl, 1,4-cyclohexanediamine, di(aminomethyl) cyclohexane, 1,4-di(aminomethyl)cyclohexane, isophoronediamine, 1,8-menthananediamine, methylenedi (cyclohexylamine), isopropylidenedi(cyclohexylamine), and 3,3'-dimethylmethylene-di(cyclohexylamine); and aromatic amines including aniline and its derivatives, diaminotoluenes, diarylamines, methylenedlianiline, and phenylenediamines. Generally, preferred amines include dialkyl amines such as dimethylamine and diethylamine, among others.

Generally, any number of synthesis may be used to synthesize the stabilized lubricants of the invention. Conventional lubricants with hydroxy functionality may be capped with an amine compound. The amine group substituted perflyuoropolyether derivatives described can be prepared by first forming the ester of the alcohol functional groups of Z-DOL with a good leaving group reactive with nucleophiles. A class of good leaving groups which can be incorporated includes, but is not limited to, various substituted sulfonate esters. Such ester groups include p-toluenesulfonate, methanesulfonate, or trifluoromethanesulfonate. The esters can be prepared by reacting the sulfonyl ahnydrides or chlorides with Z-DOL in the presence of a suitable acid accepter such as pyridine or an inorganic base. The Z-DOL sulfonate diester may then be isolated by extraction with a suitable fluorocarbon sol vent followed by removal of the solvent by distillation. The sulfonate diester may then be treated with the mono- or di-functional amine either at room temperature or with heating. After removal of excess amine and suitable solvent washing the desired product is obtained.

One molecule resulting from this synthesis has a formula as found below in formula (VII):

$$(CH_3CH_2CH_2)_2N—CH_2(CF_2CF_2O)_m(CF_2O)_nCH_2N(CH_2CH_2CH_3)_2 \quad (VII)$$

wherein the ratio of m/n is 2/3. This molecule is generally identified as z-dipropylamine.

Generally, lubricants used according to the invention may comprise from about 10 to 100 wt-%, preferably 100 wt-%, of the amine stabilized perfluoropolyether compound. The balance of the composition may be unstabilized lubricant or carrier.

C. WORKING EXAMPLES

The following examples are illustrative but not limiting of the claimed invention.

Working Example 1

To convert the lubricant polymer end alcohol group to a mesylate, 15 grams of Z-DOL and 150 mL of Dichloromethane were transferred into a 500 mL Erlenmeyer Flask. The mixture was vigorously stirred with a magnetic stirrer to shake the polymer from the bottom of the vial as much as possible. Four and a half equivalents of Dimethylamino Pyridine (8 grams) was stirred into the reaction mixture slowly, followed by the addition of three equivalents of Methanesulfonyl chloride, (4.7 mL). The reaction was allowed to proceed at room temperature for twenty four hours with continuous vigorous mixing. The solution had turned an opaque light brown color. To quench the reaction 50 mL of FC-72 solvent was added to dissolve with perfluoropolyether.

The mixture was transferred to a 250 mL separatory funnel and mixed vigorously. A gel layer formed between the dichloromethane and the FC-72 layers. The FC-72 layer was removed and three 20 mL washes of FC-72 were added to the Dichloromethane layer to remove the emulsion layer. Next 40 mL of 5 percent Sulfuric Acid was added to the FC-72 layer in another 250 mL separatory funnel and shaken vigorously. A large emulsion layer was made between the two layers. The FC-72 layer was separated as cleanly as possible, placed in another 250 mL separatory funnel and each layer was washed again with the perspective solvents. The two layers were diluted until the emulsion layer was minimal.

The FC-72 layer was then filtered through Celite® filtering agent packed over a course 50 mL glass fritt. The solvent layer was then dried with one gram of activated molecular sieves size 4A and filtered again using a glass fritt. The remaining FC-72 layer was removed by bubbling Nitrogen gas through the solvent overnight. a 70% yield was made. The remaining polymer was analyzed with NMR spectroscopy.

Working Example 2

To synthesize trifluoromethane mesylate, a ten gram sample of Z-DOL was mixed with 150 mL of Dichloromethane. Next 5.5 grains of Dimethylamino pyridine was dissolved in the solvent. Finally 4.26 mL of Trifluoromethanesulfonyl chloride was added drop wise to the mixture. The 500 mL Erlenmeyer reaction vessel was capped with a rubber stopper and wrapped with parafilm to keep out moisture and to keep the extremely volatile TSC from escaping. A very thick gelatin like solid was formed early in the reaction, but disappeared after a day of stirring. A similar color was produced to that in the methane sulfonyl chloride in Working Example 1. The reaction was allowed to proceed for twenty six hours before it was quenched by adding 100 mL of FC-72 to the reaction mixture and transferring the mixture to a separatory funnel.

The FC-72 layer took on a milky white color while the Dichloromethane layer remained yellow. The two layers were separated and washed with 100 mL of the perspective solvents to form a separation.

The FC-72 layers, now mostly clear, were pooled and filtered through a 60 mL course glass fritt packed with Celite. The mixture was run through this three times. Next the FC-72 layer was bubbled off with the help of Nitrogen. The remaining polymer product was still littered with fine particulates so a one micron glass filter was used to filter out the particulates with the help of a syringe. Eighty five percent product yield was obtained by the procedure. The product was analyzed using proton NMR spectroscopy.

Working Example 3

To convert the mesylate of Example 2 to an amine, 3.72 g of Z-Trifluoromethanesulfonate was refluxed and mixed with 40 mL of Morpholine in a 250 mL three neck flask. The mixture was refluxed under nitrogen in an oil bath at 135° C. for twenty two hours. The reaction was quenched with the addition of 40 mL FC-72 to dissolve the perfluoropolyether.

The entire mixture was transferred to a 125 mL separatory funnel and shaken vigorously. The FC-72 layer took on a milky white color while the amine layer was a yellow-orange hue. No emulsion layer was produced. The amine layer was discarded and the FC-72 layer was washed three times with 20 mL portions of Dichloromethane. The FC-72 layer had now become more clear, but still had a grayish-white tint.

About 5 grams of Celite® Filtering agent was packed over a 30 mL, course glass fritt. Using a vacuum Erlenmeyer flask, the Celite® was packed and wet with solvent followed by the addition of the FC-72 layer which was filtered through the glass fritt. The resulting product was a completely transparent FC-72 layer. Finally, the FC-72 layer was vaporized by bubbling with Nitrogen gas. The residual liquid was collected and weighed at 3.54 grams giving a 95% yield. This product was analyzed using Proton and $19_F$ NMR spectroscopy.

Working Example 4

The same procedure was followed as in Working Example 3. A sample of 4.25 g of Trifluromethanesulfonyl perfluoropolyether was mixed with 55 mL of Dipropyl amine in a 250 mL three neck flask and placed in heating oil under nitrogen. The reaction was allowed to proceed for over 72 hours. 60 mL of FC-72 was used to quench the reaction.

The solution was transferred to a 1.25 mL separatory funnel and shaken vigorously. The amine layer was discarded and the FC-72 layer was washed with one 50 mL portion of Dichloromethane, and one 10 mL wash of the same solvent. The FC-72 layer still retained a gray color.

About three grams of Celite® was used with the same procedure as above to give clear FC-72 layer. The final product was obtained after Nitrogen bubbling. The product was analyzed using Proton and $F_{19}$ NMR spectroscopy.

Working Example 5

To prepare Bis-(trifluoromethylsulfonyl) a 500 mL round-bottom three-neck flask was equipped with a mechanical overhead stirrer, thermocouple thermometer, and an addition funnel with a nitrogen gas inlet. The reaction vessel was charged with 46 grams (ca 0.0115 mol) of Zdol™, 8.43 grams (0.069 mol) of p-dimethylaminopyridine, 40 grams (0.507 mol) of pyridine, and 250 mL of methylene chloride. The apparatus was purged with dry nitrogen, then the addition funnel was charged with 32 grams (0.113 mol) of trifluoromethanesulfonic anhydride. The mixture was stirred vigorously to assure intimate contact of the two liquid phases present. The triflic anhydride was added in ca 1 mL portions every 30 minutes for about 10 hours. The reaction mixture was allowed to stir overnight at room temperature. The addition funnel was charged with a second 32.9 gram (0.117 mol) portion of trifluoromethanesulfonic anhydride which was added in ca 1 mL portions every 30 minutes to the rapidly stirred mixture. The mixture was again stirred at room temperature overnight. The reaction mixture was transferred to a separatory funnel and diluted with 400 mL of FC-72™ and 200 mL of methylene chloride. The FC-72™ layer was separated and the methylene chloride layer extracted with three 150 mL portions of FC-72™. The combined FC-72™ layer is washed with two 200 mL portions of methylene chloride and, finally, with three 150 mL portions of 1:3 ethanol/methylene chloride. The washed FC-72™ solution was stripped of solvent then pumped (100 mTorr) at room temperature for two hours to yield 46.5 grams of product suitable for preparation of the dipropylamino derivative.

Working Example 6

Preparation of Bis-(dipropylamino-(Zdol™)) derivative (2):

To prepare Bis-(dipropylamino a 250 mL round-bottom flask equipped with a magnetic stirrer, condenser with nitrogen/vacuum attachment, and a temperature-controlled heating mantle was charged with 46 grams (0.0115 mol) of the compound of Working Example 5 and 33 grams (0.328 mol, about 45 mL) of dipropylamine. The flask was evacuated followed by a nitrogen purge three times. The mixture was heated to reflux and stirred rapidly to provide intimate mixing of the two phases. The mixture was refluxed for 24–48 hours to ensure complete reaction. Excess dipropylamine was distilled under vacuum and the residue taken up in 400 mL FC-72™ (perfluorohexanes) and washed with 400 mL of 1:9 ethanol/methylene chloride. The FC-72™ layer was separated and the ethanol/methylene chloride layer extracted with two 150 mL portions of FC-72™. The combined FC-72™ extracts were washed with three 250 mL portions of 1:9 ethanol/methylene chloride followed by two 250 mL portions of 1:9 methanol/methylene chloride. The FC-72™ phase was evaporated to about 250 mL and filtered through a 3.5 cm diameter by 12 cm long column (about 38 grams) of 60–200 mesh silica gel. The silica column was rinsed with another 500 mL of FC-72™ and the combined FC-72™ solutions stripped of solvent on a rotary evaporator. The resulting colorless oil was pumped to constant weight of 100 mTorr and 60° C. to yield 41.5 grams of product.

Working Example 7

The disproportion reaction of Fomblin Z catalyzed by A1203 at 200° C. occurs in two stages, the first stage (the induction period) when the reaction results in conversion of the aluminum oxide surface to fluoride surface, and the second state when the reaction occurs much more vigorously catalyzed by the fluoride surface, a much stronger Lewis acid. A rapid material loss due to evaporation of resulting oligomers occurs during the second stage.

Figure 3:
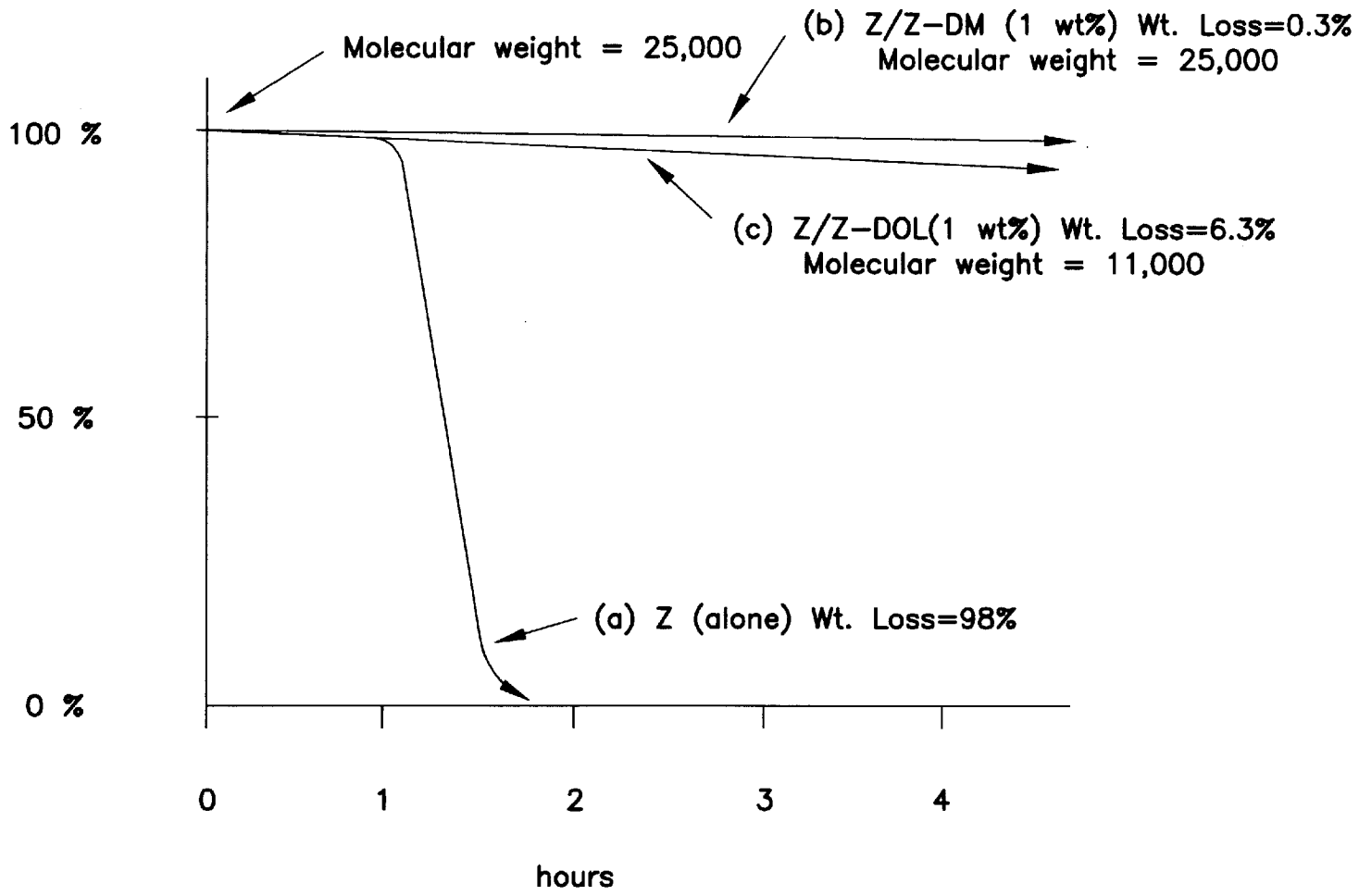
FIG. 3 is a graphical depiction of the data obtained from Working Example 7.

Curve A in FIG. 3 shows the material loss observed when 5 grams of Fomblin Z was heated at 200 C in the presence of 0.10 of $Al_2O_3$. Curve B in FIG. 3 shows the material loss observed when 5 grams of Fomblin Z mixed with 0.05 g of Z-DM was heated at 200 C in the presence of 0.10 g of $Al_2O_3$. It has been shown that Fomblin Z-DOL is more resistant to the degradation process than Fomblin Z. Curve C in FIG. 3 shows the material loss observed when 5 grams of Fomblin Z mixed with 0.05 g of Z-DOL was heated at 200 C in the presence of 0.10 g of $Al_2O_3$. The weight loss given for Curves B and C are those determined at the end of 24 hours of heating. The molecular weight of the starting PFPE and those remaining after the reaction are also indicated. It is thus shown that 1 wt % Z-DM completely suppress the degradation process, whereas 1 wt % of Z-DOL only partially suppress the process. An essentially identical result was obtained with Fomblin Z mixed with 1 wt % Z-DDPA.

The above specification, examples, and data provide a complete description of the claimed invention. Since many embodiments of the invention can be made without departing from the spirit and scope of the invention. The invention resides and the claims hereinafter appended.

The claimed invention is:

1. A lubricated thin film magnetic disk comprising:

(a) a substrate;

(b) an underlayer deposited on said substrate;

(c) a magnetic alloy film deposited on said underlayer;

(d) an overcoat; and (e) a film of lubricant deposited on said magnetic alloy film, said lubricant comprising an amine-stabilized perfluoropolyether polymer having a backbone comprising repeating units of:

$$—(CF_2)_n—O—$$

wherein n is an integer from 1 to 4 and said polymer backbone is terminated with at least one tertiary amine end group:

$$—CH_2NRR'$$

where R and R' are alkyl groups.

2. The disk of claim 1, wherein said perfluoropolyether polymer has a molecular weight ranging from about 2000 $M_N$ to 8000 $M_N$.

3. The disk of claim 1, wherein said lubricant comprises about 10 to 100 wt-% of said amine stabilized perfluoropolyether polymer.

4. The disk of claim 3, wherein the balance of said lubricant comprises an unstabilized lubricant.

5. The disk of claim 1, wherein the underlay er comprises a chromium alloy.

6. The disk of claim 5, wherein the underlay er contains greater than 5 wt. % Ti with the remainder being predominantly Cr.

7. The disk of claim 1 wherein the substrate comprises glass.

8. The disk of claim 1 wherein the overcoat comprises a hydrogenated or nitrogenated carbon overcoat.

9. A disk drive assembly comprising:

(a) a thin film magnetic disk, said disk comprising:

(i) a disk substrate;

(ii) an underlayer deposited on said substrate;

(iii) a magnetic alloy film deposited on said underlayer;

(iv) an overcoat, and (v) a film of lubricant deposited on said magnetic alloy film, said lubricant comprising an amine-stabilized perfluoropolyether polymer having a backbone comprising repeating units of:

$$—(CF_2)_n—O—$$

wherein n is an integer from 1 to 4 and said polymer backbone is terminated with at least one tertiary amine end group:

$$—CH_2NRR'$$

where R and R' are alkyl groups;

(b) means for rotating the thin film magnetic disk;

(c) a slider for reading magnetic data; and (d) means for positioning the slider over the thin film magnetic disk to read magnetic data from the disk.

10. The disk of claim 9, wherein said perfluoropolyether polymer has a molecular weight ranging from about 2,000 $M_N$ to 8,000 $M_N$.

11. The disk of claim 9, wherein said lubricant comprises about 10 to 100 wt-% of said amine stabilized perfluoropolyether polymer.

12. The disk of claim 11, wherein the balance of said lubricant comprises an unstabilized lubricant.

13. The disk of claim 9 wherein the underlayer comprises chromium alloy.

14. The disk of claim 9 wherein the substrate comprises glass.

* * * * *